US009008148B2

(12) United States Patent
Forbes Jones et al.

(10) Patent No.: US 9,008,148 B2
(45) Date of Patent: Apr. 14, 2015

(54) REFINING AND CASTING APPARATUS AND METHOD

(75) Inventors: Robin M. Forbes Jones, Charlotte, NC (US); Richard L. Kennedy, Monroe, NC (US); Ramesh S. Minisandram, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 1269 days.

(21) Appl. No.: 11/564,021

(22) Filed: Nov. 28, 2006

(65) Prior Publication Data

US 2007/0151695 A1 Jul. 5, 2007

Related U.S. Application Data

(60) Continuation of application No. 10/158,382, filed on May 30, 2002, now Pat. No. 7,154,932, which is a division of application No. 09/726,720, filed on Nov. 15, 2000, now Pat. No. 6,496,529.

(51) Int. Cl.
*H05B 3/60* (2006.01)
*C22B 9/18* (2006.01)
(Continued)

(52) U.S. Cl.
CPC . *C22B 9/18* (2013.01); *B22D 23/10* (2013.01); *C22B 9/20* (2013.01); *C22B 23/06* (2013.01)

(58) Field of Classification Search
CPC .... B22F 9/08; B22F 9/082; B22F 2009/0852; B22F 2009/0856; B22F 2009/0884; B22F 2998/00; B22D 23/003; B22D 17/007; C22B 9/18; C22B 9/20; C22B 23/06; F27B 14/06; F27B 14/063; F27B 3/19
USPC ..... 373/42, 72, 80–82, 142, 145, 156, 68, 373/45, 49, 2, 21, 44; 164/46, 486, 475, 164/469, 497, 259, 271, 266, 306, 212; 266/201, 202; 75/10.24, 10.14, 10.25, 75/314, 332, 337, 338
See application file for complete search history.

(56) References Cited

U.S. PATENT DOCUMENTS 3,005,246 A 10/1961 Murphy et al.
3,072,982 A 1/1963 Gordon et al.
(Continued)

FOREIGN PATENT DOCUMENTS

CA 2048836 3/1983
CA 2048836 A1 4/1992
(Continued)

OTHER PUBLICATIONS

D.E. Tyler and W.G. Watson, "Nucleated Casting", *Proceedings of the Third International Conference on Spray Forming*, Sep. 1996, pp. 233-242.
(Continued)

*Primary Examiner* — Henry Yuen
*Assistant Examiner* — Hung D Nguyen
(74) *Attorney, Agent, or Firm* — K & L Gates LLP; John E. Grosselin, III

(57) ABSTRACT

A method for refining and casting metals and metal alloys includes melting and refining a metallic material and then casting the refined molten material by a nucleated casting technique. The refined molten material is provided to the atomizing nozzle of the nucleated casting apparatus through a transfer apparatus adapted to maintain the purity of the molten refined material. An apparatus including a melting and refining apparatus, a transfer apparatus, and a nucleated casting apparatus, in serial fluid communication, also is disclosed.

13 Claims, 6 Drawing Sheets

(51) Int. Cl.

| | |
|---|---|
| ***B22D 23/10*** | (2006.01) |
| ***C22B 9/20*** | (2006.01) |
| ***C22B 23/06*** | (2006.01) |

(56) References Cited

U.S. PATENT DOCUMENTS 3,101,515 A 8/1963 Hanks
3,105,275 A 10/1963 Hanks
3,157,922 A 11/1964 Helmut
3,177,535 A 4/1965 Hanks
3,288,593 A 11/1966 Smith, Jr. et al.
3,342,250 A 9/1967 Treppschuh et al.
3,343,828 A 9/1967 Hunt
3,389,208 A 6/1968 Roberts et al.
3,420,977 A 1/1969 Hanks et al.
3,519,059 A 7/1970 Voskoboinikov et al.
3,547,622 A 12/1970 Hutchinson
3,576,207 A 4/1971 Grenfell et al.
3,627,293 A 12/1971 Sperner
3,690,635 A 9/1972 Harker et al.
3,702,630 A 11/1972 Peytavin et al.
3,737,305 A 6/1973 Blayden et al.
3,764,297 A * 10/1973 Coad et al. ..... 75/10.23
3,786,853 A 1/1974 Cooper
3,817,503 A 6/1974 Lafferty et al.
3,825,415 A 7/1974 Johnston et al.
3,826,301 A 7/1974 Brooks
3,868,987 A 3/1975 Galey et al.
3,896,258 A 7/1975 Hanks
3,909,921 A 10/1975 Brooks
3,970,892 A 7/1976 Wakalopulos
3,972,713 A 8/1976 Muzyka et al.
3,985,177 A 10/1976 Buehler
3,988,084 A 10/1976 Esposito et al.
3,989,091 A 11/1976 Medovar et al.
4,025,818 A 5/1977 Giguere et al.
4,058,697 A 11/1977 Sokolov et al.
4,061,944 A 12/1977 Gay
4,062,700 A 12/1977 Hayami et al.
4,066,117 A * 1/1978 Clark et al. ..... 164/46
4,136,527 A 1/1979 Kading
4,190,404 A 2/1980 Drs et al.
4,221,587 A 9/1980 Ray
4,261,412 A * 4/1981 Soykan et al. ..... 164/495
4,264,641 A 4/1981 Mahoney et al.
4,272,463 A 6/1981 Clark et al.
4,305,451 A 12/1981 Ksendzyk et al.
4,343,433 A 8/1982 Sickles
4,426,141 A 1/1984 Holcomb
4,441,542 A 4/1984 Pryor et al.
4,449,568 A 5/1984 Narasimham
4,471,831 A 9/1984 Ray
4,482,376 A 11/1984 Tarasescu et al.
4,544,404 A 10/1985 Yolton et al.
4,575,325 A 3/1986 Duerig et al.
4,596,945 A 6/1986 Schumacher et al.
4,619,597 A 10/1986 Miller
4,619,845 A 10/1986 Ayers et al.
4,631,013 A 12/1986 Miller
4,642,522 A 2/1987 Harvey et al.
4,645,978 A 2/1987 Harvey et al.
4,689,074 A 8/1987 Seaman et al.
4,694,222 A 9/1987 Wakalopulos
4,697,631 A 10/1987 Bungeroth et al.
4,730,661 A 3/1988 Stephan
4,738,713 A 4/1988 Stickle
4,755,722 A 7/1988 Wakalopulos
4,762,553 A 8/1988 Savage et al.
4,762,975 A 8/1988 Mahoney et al.
4,769,064 A 9/1988 Buss et al.
4,779,802 A 10/1988 Coombs
4,786,844 A 11/1988 Farrell et al.
4,788,016 A 11/1988 Colclough et al.
4,801,411 A 1/1989 Wellinghoff et al.
4,801,412 A 1/1989 Miller
4,838,340 A 6/1989 Entrekin et al.
4,842,170 A 6/1989 Del Vacchio et al.
4,842,704 A 6/1989 Collins et al.
4,863,509 A * 9/1989 Metz ..... 75/333
4,910,435 A 3/1990 Wakalopulos
4,916,198 A 4/1990 Scheve et al.
4,916,361 A 4/1990 Schumacher et al.
4,919,335 A 4/1990 Hobson et al.
4,926,923 A 5/1990 Brooks et al.
4,931,091 A 6/1990 Waite et al.
4,932,635 A 6/1990 Harker
4,936,375 A 6/1990 Harker
4,938,275 A 7/1990 Leatham et al.
4,955,045 A 9/1990 Friede et al.
4,961,776 A 10/1990 Harker
5,004,153 A 4/1991 Sawyer
5,074,933 A 12/1991 Ashok et al.
5,084,091 A 1/1992 Yolton
5,100,463 A 3/1992 Harker
5,102,449 A 4/1992 Ducrocq et al.
5,102,620 A 4/1992 Watson et al.
5,104,634 A 4/1992 Calcote
5,142,549 A 8/1992 Bremer
5,160,532 A 11/1992 Benz et al.
5,167,915 A 12/1992 Yamashita et al.
5,176,874 A 1/1993 Mourer et al.
5,222,547 A 6/1993 Harker
5,226,946 A 7/1993 Diehm et al.
5,240,067 A 8/1993 Hatch
5,263,044 A 11/1993 Bremer
5,266,098 A 11/1993 Chun et al.
5,268,018 A 12/1993 Mourer et al.
5,272,718 A 12/1993 Stenzel et al.
5,291,940 A 3/1994 Borofka et al.
5,296,274 A 3/1994 Movchan et al.
5,302,881 A 4/1994 O'Loughlin
5,310,165 A 5/1994 Benz et al.
5,325,906 A 7/1994 Benz et al.
5,332,197 A 7/1994 Benz et al.
5,346,184 A 9/1994 Ghosh
5,348,566 A 9/1994 Sawyer et al.
5,366,206 A 11/1994 Sawyer et al.
5,368,897 A 11/1994 Kurihara et al.
5,377,961 A 1/1995 Smith et al.
5,378,957 A 1/1995 Kelly
5,381,847 A 1/1995 Ashok et al.
5,384,821 A 1/1995 Jedlitschka et al.
5,460,851 A 10/1995 Jenkins
5,472,177 A * 12/1995 Benz et al. ..... 266/202
5,480,097 A 1/1996 Carter, Jr. et al.
5,489,820 A 2/1996 Ivanov et al.
5,503,655 A 4/1996 Joseph
5,527,381 A 6/1996 Waite et al.
5,649,992 A * 7/1997 Carter et al. ..... 75/10.14
5,649,993 A 7/1997 Carter, Jr. et al.
5,683,653 A 11/1997 Benz et al.
5,699,850 A 12/1997 Beitelman et al.
5,722,479 A 3/1998 Oeftering
5,749,938 A 5/1998 Coombs
5,749,989 A 5/1998 Linman et al.
5,769,151 A 6/1998 Carter, Jr. et al.
5,809,057 A 9/1998 Benz et al.
5,810,066 A 9/1998 Knudsen et al.
5,841,235 A 11/1998 Engelko et al.
5,894,980 A 4/1999 Orme-Marmarelis et al.
5,954,112 A 9/1999 Forbes Jones et al.
5,972,282 A 10/1999 Aguirre et al.
5,985,206 A 11/1999 Zabala et al.
5,992,503 A 11/1999 Knudsen et al.
6,043,451 A 3/2000 Julien et al.
6,068,043 A 5/2000 Clark
6,103,182 A 8/2000 Campbell
6,135,194 A 10/2000 Flinn et al.
6,156,667 A 12/2000 Jewett
6,162,377 A * 12/2000 Ghosh et al. ..... 264/9
6,168,666 B1 1/2001 Sun
6,175,585 B1 1/2001 Grosse et al.
6,264,717 B1 7/2001 Carter, Jr. et al.
6,350,293 B1 2/2002 Carter, Jr. et al.

(56) References Cited

U.S. PATENT DOCUMENTS

| | | | |
|---|---|---|---|
| 6,407,399 | B1 | 6/2002 | Livesay |
| 6,416,564 | B1 | 7/2002 | Bond |
| 6,427,752 | B1 | 8/2002 | Carter, Jr. et al. |
| 6,460,595 | B1 | 10/2002 | Benz et al. |
| 6,491,737 | B2 | 12/2002 | Orme-Marmerelis et al. |
| 6,496,529 | B1 | 12/2002 | Jones et al. |
| 6,562,099 | B2 | 5/2003 | Orme-Marmerelis et al. |
| 6,613,266 | B2 | 9/2003 | McDonald |
| 6,631,753 | B1 | 10/2003 | Carter, Jr. et al. |
| 6,772,961 | B2 | 8/2004 | Forbes Jones et al. |
| 6,904,955 | B2 | 6/2005 | Jackson et al. |
| 6,975,073 | B2 | 12/2005 | Wakalopulos |
| 7,033,444 | B1 | 4/2006 | Komino et al. |
| 7,114,548 | B2 | 10/2006 | Forbes Jones et al. |
| 7,150,412 | B2 | 12/2006 | Wang et al. |
| 7,152,432 | B2 | 12/2006 | Wanner et al. |
| 7,154,932 | B2 | 12/2006 | Forbes Jones et al. |
| 7,337,745 | B1 | 3/2008 | Komino et al. |
| 7,374,598 | B2 | 5/2008 | Forbes Jones et al. |
| 7,425,716 | B2 | 9/2008 | Demos et al. |
| 7,439,188 | B2 | 10/2008 | DeOrnellas et al. |
| 7,578,960 | B2 | 8/2009 | Forbes Jones et al. |
| 7,798,199 | B2 | 9/2010 | Forbes Jones et al. |
| 7,803,211 | B2 | 9/2010 | Forbes Jones |
| 7,803,212 | B2 | 9/2010 | Forbes Jones et al. |
| 8,156,996 | B2 | 4/2012 | Forbes Jones et al. |
| 8,216,339 | B2 | 7/2012 | Forbes Jones et al. |
| 2004/0065171 | A1 | 4/2004 | Hearley et al. |
| 2005/0173847 | A1 | 8/2005 | Blackburn et al. |
| 2007/0062332 | A1 | 3/2007 | Jones et al. |
| 2008/0072707 | A1 | 3/2008 | Forbes Jones et al. |
| 2008/0115905 | A1 | 5/2008 | Forbes Jones et al. |
| 2008/0179033 | A1 | 7/2008 | Forbes Jones et al. |
| 2008/0179034 | A1 | 7/2008 | Forbes Jones et al. |
| 2008/0223174 | A1 | 9/2008 | Forbes Jones et al. |
| 2008/0237200 | A1 | 10/2008 | Forbes Jones et al. |
| 2009/0139682 | A1 | 6/2009 | Forbes Jones et al. |
| 2010/0012629 | A1 | 1/2010 | Forbes Jones et al. |
| 2010/0258262 | A1 | 10/2010 | Forbes Jones et al. |
| 2010/0276112 | A1 | 11/2010 | Forbes Jones et al. |
| 2010/0314068 | A1 | 12/2010 | Forbes Jones et al. |
| 2012/0168110 | A1 | 7/2012 | Forbes Jones et al. |
| 2013/0279533 | A1 | 10/2013 | Forbes Jones et al. |

FOREIGN PATENT DOCUMENTS

| | | | |
|---|---|---|---|
| DE | 3810294 | | 12/1985 |
| DE | 3810294 | | 10/1988 |
| DE | 4011392 | B4 | 4/2004 |
| EP | 0073585 | A1 | 3/1983 |
| EP | 0095298 | A1 | 11/1983 |
| EP | 0073585 | A1 | 1/1986 |
| EP | 0225732 | B1 | 6/1987 |
| EP | 0400089 | B1 | 10/1988 |
| EP | 0428527 | B1 | 10/1988 |
| EP | 0486830 | A2 | 2/1990 |
| EP | 1101552 | A2 | 2/1991 |
| EP | 0486830 | A2 | 5/1992 |
| EP | 0518536 | A1 | 12/1992 |
| EP | 0400089 | B1 | 6/1993 |
| EP | 0428527 | B1 | 8/1996 |
| EP | 1101552 | A2 | 5/2001 |
| GB | 2203889 | A | 10/1988 |
| GB | 2203889 | A | 4/1992 |
| JP | S63-128134 | A | 5/1988 |
| JP | 01-313181 | A | 12/1989 |
| JP | 01-313182 | A | 12/1989 |
| JP | 3-36205 | A | 2/1991 |
| JP | H03-36205 | | 5/1992 |
| JP | 6-246425 | | 9/1994 |
| JP | 8-506382 | A | 7/1996 |
| JP | 2001-212662 | A | 8/2001 |
| JP | 2001-279340 | A | 10/2001 |
| JP | 2001-335854 | A | 12/2001 |
| JP | 2004-108696 | A | 4/2004 |
| JP | 2006-207838 | A | 8/2006 |
| RU | 2089633 | C1 | 6/1993 |
| RU | 2089633 | C1 | 9/1997 |
| WO | WO 85/05489 | A1 | 12/1985 |
| WO | WO 86/00466 | A1 | 1/1986 |
| WO | WO 90/01250 | A1 | 2/1990 |
| WO | WO 97/49837 | A1 | 12/1997 |
| WO | WO 01/96028 | A1 | 12/2001 |
| WO | WO 02/40197 | A2 | 5/2002 |

OTHER PUBLICATIONS

E.J. Lavernia and Y. Wu, "Spray Atomization and Deposition" (John Wiley & Sons, 1996), pp. 311-314.

L.A. Bertram et al., "Quantitative Simulations of a Superalloy VAR Ingot at the Macroscale", *Proceedings of the 1997 International Symposium on Liquid Metal Processing and Casting*, A. Mitchell and P. Auburtin, eds., (Am. Vac. Soc., 1997)., pp. 110-132.

JOM, "Solidification Processing of Materials in Magnetic Fields", copyright held by *The Minerals, Metals & Materials Society*, 1998.

William T. Carter, Jr. and Robin M. Forbes-Jones, "Nucleated Casting for Land-Based Gas Turbines", *Advanced Materials & Processes*, Jul. 2002, pp. 27-29.

Alan Leatham, "Spray Forming: Alloys, Products, and Markets", *JOM-e*, Apr. 1999 (vol. 51, No. 4) 13 pages.

W.T. Carter, Jr. et al. "The CMSF Process: The Spray Forming of Clean Metal", *JOM-e*, Apr. 1999 (vol. 51, No. 4) 7 pages.

William T. Carter, Jr. and Robin M. Forbes-Jones, "Nucleated Casting for the Production pf Large Superalloy Ingots", *JOM*, Apr. 2005, pp. 52-57.

Sears, Francis Weston, An Introduction to Thermodynamics, the Kinetic Theory of Gases, and Statistical Mechanics, 2nd Edition, Addison-Wesley, 1959, pp. 335-337.

Macky, W.A., "Some Investigations on the Deformation of Water Droplets in Strong Electric Fields", Proc. Roy. Soc. London, Series A, 133, pp. 565-587, 1931.

V. A. Chernov, "Powerful High-Voltage Glow Discharge Electron Gun and Power Unit on Its Base," 1994 Intern. Conf. on Electron Beam Melting (Reno, Nevada), pp. 259-267.

H. Duval, et al., "Theoretical and Experimental Approach of the Volatilization in Vacuum Metallurgy," pp. 83-97 (date unknown).

E. M. Oks, et al., "Development of Plasma Cathode Electron Guns," Physics of Plasmas, vol. 6, No. 5, pp. 1649-1654, May 1999.

W. Clark, "Electron Gun Technology," Hughes Research Laboratories, Final Report No. N00014-72-C-0496, 92 pages, Dec. 1976.

"Electron-Beam Melting of Titanium," printed from http://www.antares.com.ua, Internet site, website accessed on Apr. 4, 2007, 6 pages.

ALD Vacuum Technologies AG, "Electron Beam Melting (EB), Electron Beam Melting Processes and Furnaces," 6 pages, (date unknown).

G. Wakalopulos, "Pulsed WIP Electron Gun. Final Report—Fabrication Phase 1×40 cm and 1×70 cm Cooled WIP Electron Gun," Mar. 1979-Dec. 1980.

W. M. Clark, et al., "Ion Plasma Electron Gun Research," Dec. 1977.

G. Sanchez, et al., "Thermal Effect of Ion Implantation with Ultra-Short Ion Beams," Surface and Coatings Technology, vol. 70, pp. 181-186 (1995).

M. L. Sentis, et al., "Parametric Studies of X-Ray Preionized Discharge XeCl Laser at Single Short and at High Pulse Rate Frequency (1 kHz)," J. Appl. Phys., vol. 66, No. 5, pp. 1925-1930, Sep. 1, 1989.

L. Arif, et al., "Waves Behaviour in a High Repetition High Average Power Excimer Laser," SPIE vol. 1031 GCL—Seventh International Symposium on Gas Flow and Chemical Lasers, pp. 392-399 (1988).

N. N. Semashko, "Sources of Gas-Ion Beams with Current up to 60 A for Controlled Thermonuclear Fusion and Technological Applications," Atomic Energy, vol. 82, No. 1, pp. 21-27, 1997.

B. A. Knyazev, et al., "Pulsed Plasma Sources for the Production of Intense Ion Beams Based on "Catalytic" Resonance Ionization," 18 pages, 1994.

B. L. Fontaine, et al., "Performance Characteristics of a Long Pulse and High Average Power XeCl Discharge Laser," SPIE vol. 801, High Power Lasers, pp. 100-105 (1987).

(56) References Cited

OTHER PUBLICATIONS

Sandia National Labs, "Particle Beam Fusion Progress Report, Jan.-Jun. 1980," published May 1981.
P. F. McKay, "Development of a Twelve-Plasma Gun, Single-Pulser Combination for Use in the PBFA-1 Hybrid Ion Diode," published Oct. 1985.
A. J. Cohen, "Anomalous Diffusion in a Plasma Formed from the Exhaust Beam of an Electron-Bombardment Ion Thruster," published Aug. 1968.
L. E. Weddle, "Ion Gun Generated Electromagnetic Interference on the Scatha Satellite," Dec. 1987.
S. Suckewer, "Spectral Measurements of Plasma Temperature in the Rod Plasma Injector (RPI)," Nukleonika, No. 1, 1970.
R. C. Olsen, et al., "Plasma Wave Observations During Ion Gun Experiments," Journal of Geophysical Research, vol. 95, No. A6, pp. 7759-7771, Jun. 1, 1990.
Y. Kiwamoto, "Small Barium Rail Gun for Plasma Injection," Rev. Sci. Instrum., vol. 51. No. 3, pp. 285-287, Mar. 1980.
S. Humphries, Jr., et al., "Pulsed Plasma guns for Intense Ion Beam Injectors," Rev. Sci. Instrum. vol. 52, No. 2, pp. 162-171, Feb. 1981.
H. Tamura, et al., "A Plasma Ion Gun with Pierce Electrode," Japan J. Appl. Phys. 5, pp. 985-987 (1966).
V. M. Chicherov, "Density Distribution of Hydrogen in the Interior of a Coaxial Plasma Injector Prior to the Application of High Voltage to its Electrodes," Journal of Technical Physics, vol. 36, No. 6, pp. 1055-1057, 1966.
L. M. Smith, et al., "Interferometric Investigation of a Cablegun Plasma Injector," IEEE Transactions on Plasma Science, vol. 28, No. 6, pp. 2272-2275, Dec. 2000.
A. Vizir, et al., "Recent Development and Applications of Electron, Ion and Plasma Sources Based on Vacuum Arc and Low Pressure Glow," IEEE Int. Conf. Plasma Sci., p. 286 (2004).
Kuiken, Gerard, "Thermodynamics of Irreversible Processes: Applications to Diffusion and Rheology", John Wiley & Sons, Oct. 1994.
Cobine, James Dillon, "Gaseous Conductors: Theory and Engineering Applications", Dover Publications, Inc. New York (1958).
U.S. Appl. No. 12/055,415, filed Mar. 26, 2008.
ALD Vacuum Technologies: Electron Beam Melting (EB), printed from http://web.ald-vt.de/cms/vakuum-technologie/anlagen/electron-beam-melting-eb, website accessed on Aug. 25, 2009, 4 pages.
Bakish, R., "The Substance of Technology: Electron Beam Melting and Refining", JOM, Nov. 1998, pp. 28-30.
Hasse, Rolf, "Thermodynamics of Irreversible Processes", Dover Publications, Inc., New York, 1990, 5 pages.
Office Action dated Dec. 21, 2007 in U.S. Appl. No. 11/232,702.
Office Action dated Jul. 18, 2008 in U.S. Appl. No. 11/232,702.
Office Action dated Dec. 12, 2008 in U.S. Appl. No. 11/232,702.
Notice of Allowance dated Apr. 13, 2009 in U.S. Appl. No. 11/232,702.
Office Action dated Mar. 11, 2009 in U.S. Appl. No. 11/933,361.
Office Action dated Nov. 10, 2009 in U.S. Appl. No. 11/933,361.
Office Action dated Feb. 13, 2009 in U.S. Appl. No. 11/841,941.
Office Action dated Oct. 1, 2009 in U.S. Appl. No. 11/841,941.
Office Action dated Jun. 28, 2007 in U.S. Appl. No. 10/913,361.
Office Action dated Sep. 26, 2007 in U.S. Appl. No. 10/913,361.
Notice of Allowance dated Jan. 14, 2008 in U.S. Appl. No. 10/913,361.
Office Action dated Dec. 19, 2002 in U.S. Appl. No. 10/158,382.
Office Action dated Jun. 3, 2003 in U.S. Appl. No. 10/158,382.
Office Action dated Mar. 18, 2004 in U.S. Appl. No. 10/158,382.
Office Action dated Dec. 29, 2004 in U.S. Appl. No. 10/158,382.
Office Action dated Aug. 25, 2005 in U.S. Appl. No. 10/158,382.
Notice of Allowance dated May 2, 2006 in U.S. Appl. No. 10/158,382.
Supplemental Notice of Allowability dated Jun. 12, 2006 in U.S. Appl. No. 10/158,382.
Supplemental Notice of Allowability dated Jun. 29, 2006 in U.S. Appl. No. 10/158,382.
Office Action dated Nov. 20, 2002 in U.S. Appl. No. 09/882,248.
Office Action dated Jan. 21, 2003 in U.S. Appl. No. 09/882,248.
Office Action dated Jul. 8, 2003 in U.S. Appl. No. 09/882,248.
Notice of Allowance dated Oct. 22, 2003 in U.S. Appl. No. 09/882,248.
Office Action dated Dec. 6, 2001 in U.S. Appl. No. 09/726,720.
Notice of Allowance dated Apr. 23, 2002 in U.S. Appl. No. 09/726,720.
Office Action dated Aug. 29, 2005 in U.S. Appl. No. 11/008,048.
Office Action dated Nov. 8, 2005 in U.S. Appl. No. 11/008,048.
Response to Rule 312 Communication dated Aug. 16, 2006 in U.S. Appl. No. 11/008,048.
Notice of Allowance dated Jun. 27, 2006 in U.S. Appl. No. 11/008,048.
Office Action dated Nov. 27, 2009 in U.S. Appl. No. 12/053,238.
Office Action dated Dec. 9, 2009 in U.S. Appl. No. 12/053,245.
Tien et al., "Superalloys, Supercomposites and Superceramics", Academic Press, Inc., Dec. 1989, pp. 49, 76-84.
Ausmus, S.L. and R.A. Beall, "Electroslag Melting of Titanium Slabs", Trans. Internat., Vacuum Metallurgy Conf., Dec. 1967, pp. 675-694.
Chronister et al., "Induction Skull Melting of Titanium and Other Reactive Alloys", Journal of Metals, Sep. 1986, pp. 51-54.
Cao, "Solidification and Solid State Phase Transformation of Allvac® 718Plus™ Alloy", Journal of the Minerals, Metals & Materials Society, 2005, pp. 165-177.
Office Action dated May 15, 2012 in U.S. Appl. No. 12/055,415.
Office Action dated May 2, 2011 in U.S. Appl. No. 12/502,558.
Notice of Allowance dated Jun. 22, 2011 in U.S. Appl. No. 12/502,558.
Notice of Allowance dated Feb. 13, 2012 in U.S. Appl. No. 12/502,558.
Corrected Notice of Allowability dated Jun. 12, 2012 in U.S. Appl. No. 12/502,558.
Notice of Allowance dated Feb. 17, 2011 in U.S. Appl. No. 12/861,033.
Office Action dated Jul. 14, 2011 in U.S. Appl. No. 11/978,923.
Office Action dated Oct. 20, 2011 in U.S. Appl. No. 11/978,923.
Office Action dated May 4, 2012 in U.S. Appl. No. 11/978,923.
Office Action dated Aug. 3, 2011 in U.S. Appl. No. 13/108,402.
Notice of Allowance dated Dec. 21, 2011 in U.S. Appl. No. 13/108,402.
U.S. Appl. No. 13/207,629, filed Aug. 11, 2011.
Office Action dated Dec. 14, 2011 in U.S. Appl. No. 12/831,669.
Notice of Allowance dated Mar. 9, 2012 in U.S. Appl. No. 12/831,669.
Notice of Allowability dated Jun. 22, 2012 in U.S. Appl. No. 12/831,669.
Office Action dated Jun. 18, 2012 in U.S. Appl. No. 13/420,910.
Notice of Allowance dated Sep. 10, 2012 in U.S. Appl. No. 13/420,910.
Notice of Allowance dated Apr. 12, 2012 in U.S. Appl. No. 12/821,480.
Notice of Allowability dated Jun. 26, 2012 in U.S. Appl. No. 12/821,480.
Office Action dated Oct. 10, 2012 in U.S. Appl. No. 12/546,785.
Office Action dated Jul. 12, 2010 in U.S. Appl. No. 11/841,941.
Office Action dated Jun. 3, 2010 in U.S. Appl. No. 12/053,238.
Notice of Allowance dated Jul. 2, 2010 in U.S. Appl. No. 12/053,238.
Notice of Allowance dated Jun. 9, 2010 in U.S. Appl. No. 12/053,245.
Notice of Allowance dated Jun. 2, 2010 in U.S. Appl. No. 11/949,808.
Office Action dated Jun. 25, 2010 in U.S. Appl. No. 12/502,558.
Office Action dated Sep. 23, 2010 in U.S. Appl. No. 12/502,558.
Notice of Allowance dated Jan. 3, 2011 in U.S. Appl. No. 12/861,033.
Bhatia, A., "Thermal Spraying Technology and Applications", Continuing Education and Development, Inc. Jan. 29, 1999, 91 pages.
Office Action dated Dec. 20, 2012 in U.S. Appl. No. 12/055,415.
Notice of Allowance dated Jun. 11, 2013 in U.S. Appl. No. 12/055,415.
Notice of Allowance dated Oct. 8, 2013 in U.S. Appl. No. 12/055,415.
Office Action dated May 24, 2013 in U.S. Appl. No. 13/207,629, filed.
Notice of Allowance dated Feb. 4, 2014 in U.S. Appl. No. 13/207,629, filed.
Office Action dated Jan. 24, 2013 in U.S. Appl. No. 12/546,785.

(56) References Cited

OTHER PUBLICATIONS

Office Action dated Sep. 30, 2013 in U.S. Appl. No. 12/546,785.
Notice of Allowance dated Dec. 2, 2013 in U.S. Appl. No. 12/546,785.
Notice of Allowance dated Feb. 19, 2014 in U.S. Appl. No. 12/546,785.
Office Action dated Apr. 8, 2014 in U.S. Appl. No. 11/978,923.
U.S. Appl. No. 14/260,570, filed Apr. 24, 2014.
U.S. Appl. No. 14/265,775, filed Apr. 30, 2014.

* cited by examiner

REFINING AND CASTING APPARATUS AND METHOD

CROSS REFERENCE TO RELATED APPLICATIONS

The present application is a continuation application claiming priority under 35 U.S.C. §120 from co-pending U.S. patent application Ser. No. 10/158,382, entitled REFINING AND CASTING APPARATUS, filed on May 30, 2002, which is a divisional application of U.S. patent application Ser. No. 09/726,720, entitled REFINING AND CASTING APPARATUS AND METHOD, filed on Nov. 15, 2000, which is now U.S. Pat. No. 6,496,529, the entire disclosures of which are incorporated by reference herein.

STATEMENT REGARDING FEDERALLY SPONSORED RESEARCH OR, DEVELOPMENT

Not applicable.

TECHNICAL FIELD AND INDUSTRIAL APPLICABILITY OF THE INVENTION

The present invention relates to an apparatus and a method for refining and casting metal and metal alloy ingots and other preforms. The present invention more particularly relates to an apparatus and a method useful for refining and casting large diameter ingots and other preforms of metals and metal alloys prone to segregation during casting, and wherein the preforms formed by the apparatus and method may exhibit minimal segregation and lack significant melt-related defects. The apparatus and method of the invention find particular application in, for example, the refinement and casting of complex nickel-based superalloys, such as alloy 706 and alloy 718, as well as certain titanium alloys, steels, and cobalt-base alloys that are prone to segregation when cast by conventional, state-of-the-art methods. The present invention is also directed to preforms and other articles produced by the method and/or apparatus of the present invention.

DESCRIPTION OF THE INVENTION BACKGROUND

In certain critical applications, components must be manufactured from large diameter metal or metal alloy preforms exhibiting minimal segregation and which are substantially free of melt-related defects such as white spots and freckles. (For ease of reference, the term "metallic material" is used herein to refer collectively to unalloyed metals and to metal alloys.) These critical applications include use of metal components as rotating components in aeronautical or land-based turbines and in other applications in which metallurgical defects may result in catastrophic failure of the component. So that preforms from which these components are produced are free of deleterious non-metallic inclusions, the molten metallic material must be appropriately cleaned or refined before being cast into a preform. If the metallic materials used in such applications are prone to segregation when cast, they are typically refined by a "triple melt" technique which combines, sequentially, vacuum induction melting (VIM), electroslag remelting (ESR), and vacuum arc remelting (VAR). Metallic materials prone to segregation, however, are difficult to produce in large diameters by VAR melting, the last step in the triple melt sequence, because it is difficult to achieve a cooling rate that is sufficient to minimize segregation. Although solidification microsegregation can be minimized by subjecting cast ingots to lengthy homogenization treatments, such treatments are not totally effective and may be costly. In addition, VAR often will introduce macro-scale defects, such as white spots, freckles, center segregation, etc., into the ingots. In some cases, large diameter ingots are fabricated into single components, so VAR-introduced defects cannot be selectively removed prior to component fabrication. Consequently, the entire ingot or a portion of the ingot may need to be scrapped. Thus, disadvantages of the triple melt technique may include large yield losses, lengthy cycle times, high materials processing costs, and the inability to produce large-sized ingots of segregation-prone metallic materials of acceptable metallurgical quality.

One known method for producing high quality preforms from melts of segregation prone metallic materials is spray forming, which is generally described in, for example, U.S. Pat. Nos. 5,325,906 and 5,348,566. Spray forming is essentially a "moldless" process using gas atomization to create a spray of droplets of liquid metal from a stream of molten metal. The process parameters of the spray forming technique are adjusted such that the average fraction of solid within the atomized droplets at the instant of impact with a collector surface is sufficiently high to yield a high viscosity deposit capable of assuming and maintaining a desired geometry. High gas-to-metal mass ratios (one or greater) are required to maintain the heat balance critical to proper solidification of the preform.

Spray forming suffers from a number of disadvantages that make its application to the formation of large diameter preforms problematic. An unavoidable byproduct of spray forming is overspray, wherein the metal misses the developing preform altogether or solidifies in flight without attaching to the preform. Average yield losses due to overspray in spray forming can be 20-30%. Also, because relatively high gas-to-metal ratios are required to maintain the critical heat balance necessary to produce the appropriate solids fraction within the droplets on impact with the collector or developing preform, the rapid solidification of the material following impact tends to entrap the atom/zing gas, resulting in the formation of gas pores within the preform.

A significant limitation of spray forming preforms from segregation prone metallic materials is that preforms of only limited maximum diameter can be formed without adversely affecting microstructure and macrostructure. Producing larger spray formed preforms of acceptable quality requires increasingly greater control of the local temperature of the spray to ensure that a semi-liquid spray surface layer is maintained at all times. For example, a relatively cooler spray may be desirable near the center of the preform, while a progressively warmer spray is desired as the spray approaches the outer, quicker cooling areas of the preform. The effective maximum diameter of the preform is also limited by the physics of the spray forming process. With a single nozzle, the largest preforms possible have a maximum diameter of approximately 12-14 inches. This size limitation has been established empirically due to the fact that as the diameter of the preform increases, the rotational speed of the surface of the preform increases, increasing the centrifugal force experienced at the semi-liquid layer. As the diameter of the preform approaches the 12 inch range, the increased centrifugal force exerted on the semi-liquid layer tends to cause the layer to be thrown from the preform face.

Accordingly, there are significant drawbacks associated with certain known techniques applied in the refining and casting of preforms, particularly large diameter preforms, from segregation prone metallic materials. Thus, a need exists for an improved apparatus and method for refining and casting segregation prone metals and metal alloys.

BRIEF SUMMARY OF THE INVENTION

In order to address the above-described need the present invention provides a method of refining and casting a preform including the steps of providing a consumable electrode of a metallic material and then melting and refining the electrode to provide a molten refined material. At least a portion of the molten refined material passes through a passage that is protected from contamination by contact with oxygen in the ambient air. The passage preferably is constructed of a material that will not react with the molten refined material. A droplet spray of the molten refined material is formed by impinging a gas on a flow of the molten refined material emerging from the passage. The droplet spray is deposited within a mold and solidified to a preform. The preform may be processed to provide a desired article such as, for example, a component adapted for rotation in an aeronautical or land-based turbine.

The step of melting and refining the consumable electrode may consist of at least one of electroslag remelting the consumable electrode and vacuum arc remelting the consumable electrode to provide the molten refined material. The passage through which the molten refined material then passes may be a passage formed through a cold induction guide. At least a portion of the molten refined alloy passes trough the cold induction guide and is inductively heated within the passage. In less demanding applications, e.g., applications in which some small level of oxide contaminants in the alloy can be tolerated, a cold induction guide need not be used. Components used in such less demanding applications include, for example, static components of aircraft turbine engines. In cases in which a cold induction guide is not used, the passage may be an unheated passage protected from the atmosphere and including walls composed of a refractory material. The passage may be adapted to protect the molten refined material from undesirable impurities. The molten refined material emerging from the passage is then solidified to a preform as noted above.

The present invention also addresses the above-described need by providing an apparatus for refining and casing an alloy. The apparatus includes a melting and refining apparatus that includes: at least one of an electroslag remelting apparatus and a vacuum arc remelting apparatus; a transfer apparatus (such as, for example, a cold induction guide) in fluid communication with the melting and refining apparatus; and a nucleated casting apparatus in fluid communication with the transfer apparatus. A consumable electrode of a metallic material introduced into the melting and refining apparatus is melted and refined, and the molten refined material passes to the nucleated casting apparatus via a passage formed through the transfer apparatus. In the case where the transfer apparatus is a cold induction guide, at least a portion of the refined material is retained in molten form in the passage of the cold induction guide by inductive heating.

When casting a metallic material by certain embodiments of the method of the present invention, the material need not contact the oxide refractories used in the melting crucibles and pouring nozzles utilized in conventional casting processes. Thus, the oxide contamination that occurs on spalling, erosion, and reaction of such refractory materials may be avoided.

The electroslag remelting apparatus that may be a part of the refining and casting apparatus of the present invention includes a vessel having an aperture therein, an electric power supply in contact with the vessel, and an electrode feed mechanism configured to advance a consumable electrode into the vessel as material is melted from the electrode during the electroslag remelting procedure. A vacuum arc remelting apparatus differs from an electroslag remelting apparatus in that the consumable electrode is melted in a vessel by means of a DC are under partial vacuum, and the molten alloy droplets pass to the transfer apparatus of the apparatus of the invention without first contacting a slag. Although vacuum arc remelting does not remove microscale inclusions to the extent of electroslag remelting, it has the advantages of removing dissolved gases and minimizing high vapor pressure trace elements in the electrode material.

The cold induction guide that may be a part of the casting and refining apparatus of the invention generally includes a melt collection region that is in direct or indirect fluid communication with the aperture of the vessel of the melting and refining apparatus. The cold induction guide also includes a transfer region defining the passage, which terminates in an orifice. At least one electrically conductive coil may be associated with the transfer region and may be used to inductively heat material passing through the passage. One or more coolant circulation passages also may be associated with the transfer region to allow for cooling of the inductive coils and the adjacent wall of the passage.

The nucleated casting apparatus of the casting and refining apparatus of the invention includes an atomizing nozzle in direct or indirect fluid communication with the passage of the transfer apparatus. An atomizing gas supply is in communication with the nozzle and forms a droplet spray from a flow of a melt received from the transfer apparatus. A mold, which includes a base and side wall to which the preform conforms, is disposed adjacent to the atomizing nozzle, and the position of the mold base relative to the atomizing nozzle may be is adjustable.

The method and apparatus of the invention allow a refined melt of a metallic material to be transferred to the nucleated casting apparatus in molten or semi-molten form and with a substantially reduced possibility of recontamination of the melt by oxide or solid impurities. The nucleated casting technique allows for the formation of fine grained preforms lacking substantial segregation and melt-related defects associated with other casting methods. By associating the refining and casting features of the invention via the transfer apparatus, large or multiple consumable electrodes may be electroslag remelted or vacuum arc remelted to form a continuous stream of refined molten material that is nucleation cast into a fine grained preform. In that way, preforms of large diameter may be conveniently cast from metallic materials prone to segregation or that are otherwise difficult to cast by other methods. Conducting the method of the invention using large and/or consumable electrodes also makes it possible to cast large preforms in a continuous manner.

Accordingly, the present invention also is directed to preforms produced by the method and/or apparatus of the invention, as well as articles such as, for example, components for aeronautical or land-based turbines, produced by processing the preforms of the present invention. The present invention also is directed to preforms and ingots of segregation prone alloys of 12 inches or more in diameter and which lack significant melt-related defects. Such preforms and ingots of the invention may be produced by the method and apparatus of the present invention with levels of segregation characteristic of smaller diameter VAR or ESR ingots of the same material. Such segregation prone alloys include, for example, alloy 706, alloy 718, alloy 720, Rene 88, and other nickel-based superalloys.

The reader will appreciate the foregoing details and advantages of the present invention, as well as others, upon consideration of the following detailed description of embodiments of the invention. The reader also may comprehend such additional advantages and details of the present invention upon carrying out or using the invention.

BRIEF DESCRIPTION OF THE DRAWINGS

The features and advantages of the present invention may be better understood by reference to the accompanying drawings in which.

DETAILED DESCRIPTION OF EMBODIMENTS OF THE INVENTION

In one aspect, the present invention provides a novel process for refining a metallic material and casting the material to a preform. The preform may be processed to provide a finished article. The process of the invention includes melting and refining the metallic material and subsequently casting the material to a preform by a nucleated casting technique. Melting and refining the material may be accomplished by, for example, electroslag remelting (ESR) or vacuum arc remelting (AR). The process of the invention also includes transferring the molten refined material to a nucleated casting apparatus through a passage so as to protect it from contamination. The passage may be that formed through a cold induction guide (CIG) or another transfer apparatus.

The present invention also provides an apparatus combining at least an apparatus for melting and refining the metallic material, an apparatus for producing the preform from the molten refined material by nucleated casting, and a transfer apparatus for transferring the molten refined material from the melting and refining apparatus to the nucleated casting apparatus. As further described below, the apparatus and method of the invention are particularly advantageous when applied in the production of large diameter, high purity preforms from metallic materials prone to segregation during casting. For example, large diameter (12-14 inches or more) preforms may be produced from segregation prone and other difficult to cast metallic materials by the present apparatus and method which are substantially free from melt-related defects and exhibit minimal segregation.

Figure 1:
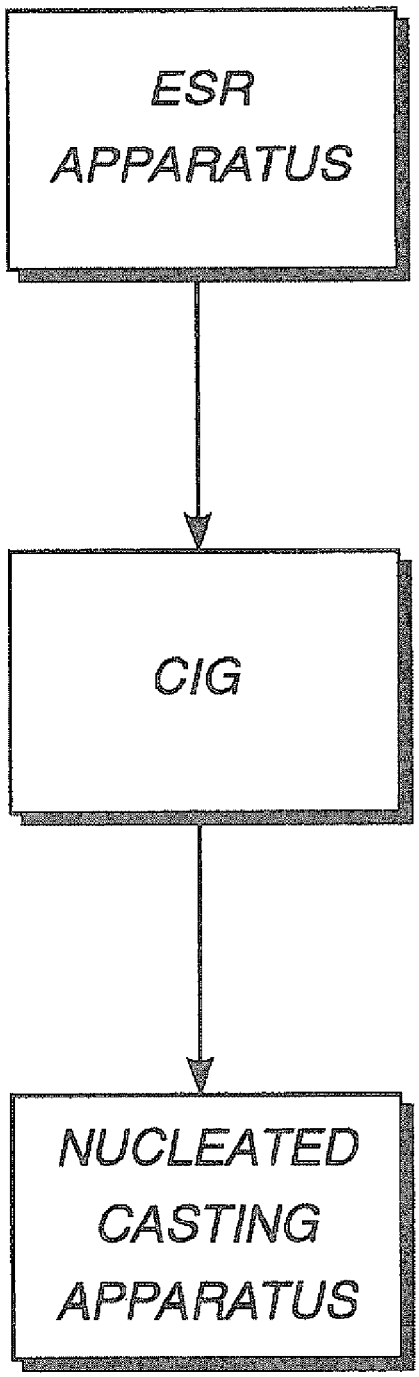
FIG. 1 is a block diagram of an embodiment of the refining and casting method according to the present invention.

One embodiment of the apparatus and method of the present invention is depicted in FIG. 1. In a first step, a consumable electrode of a metallic material is subjected to ESR, in which a refined heat of the material is generated by passage of electric current through the electrode and an electrically conductive slag disposed within a refining vessel and in contact with the electrode. The droplets melted from the electrode pass through and are refined by the conductive slag, are collected by the refining vessel, and may then be passed to a downstream apparatus. The basic components of an ESR apparatus typically include a power supply, an electrode feed mechanism, a water cooled copper refining vessel, and the slag. The specific slag type used will depend on the particular material being refined. The ESR process is well known and widely used, and the operating parameters that will be necessary for any particular electrode type and size may readily be ascertained by one having ordinary skill in the art. Accordingly, finer detailed discussion of the manner of construction or mode of operation of an ESR apparatus or the particular operating parameters used for a particular material and/or electrode type and size is unnecessary.

As finer indicated in FIG. 1, the embodiment also includes a CIG in fluid communication, either directly or indirectly, with the ESR apparatus. The CIG is used to transfer the refined melt produced in the ESR to a nucleated casting apparatus. The CIG maintains the molten refined material produced by ESR in a molten form during transfer to the nucleated casting apparatus. The CIG also maintains the purity of the melt achieved through ESR by protecting the molten material from the atmosphere and from the recontamination that can result from the use of a conventional nozzle. The CIG preferably is directly coupled to both the ESR apparatus and the nucleated casting apparatus so as to better protect the refined molten material from the atmosphere, preventing oxides from forming in and contaminating the melt. Properly constructed, the CIG also may be used to meter the flow of the molten refined material from the ESR apparatus to the nucleated casting apparatus. The construction and manner of use of a CIG, also variously referred to as a cold finger or cold wall induction guide, is well known in the art and is described in, for example, U.S. Pat. Nos. 5,272,718, 5,310,165, 5,348,566, and 5,769,151, the entire disclosures of which are hereby incorporated herein by reference. A CIG generally includes a melt container for receiving molten material. The melt container includes a bottom wall in which is formed an aperture. A transfer region of the CIG is configured to include a passage, which may be generally funnel-shaped, constructed to receive molten material from the aperture in the melt container. In one conventional construction of a CIG, the wall of the funnel-shaped passage is defined by a number of fluid-cooled metallic segments, and the fluid-cooled segments define an inner contour of the passage that generally decreases in cross-sectional area from an inlet end to an outlet end of the region. One or more electrically conductive coils are associated with the wall of the funnel-shaped passage, and a source of electrical current is in selective electrical connection with the conductive coils.

During the time that the molten refined material is flowing from the melt container of the CIG through the passage of the CIG, electrical current is passed through the conductive coils at an intensity sufficient to inductively heat the molten material and maintain it in molten form. A portion of the molten material contacts the cooled wall of the funnel-shaped passage of the CIG and may solidify to form a skull that insulates the remainder of the melt flowing through the CIG from contacting the wall. The cooling of the wall and the formation of the skull assures that the melt is not contaminated by the metals or other constituents from which the inner walls of the CIG are formed. As is known in the art, the thickness of the skull at a region of the funnel-shaped portion of the CIG may be controlled by appropriately adjusting the temperature of the coolant, the flow rate of the coolant, and/or the intensity of the current in the induction coils to control or entirely shut off the flow of the melt though the CIG; as the thickness of the skull increases, the flow through the transfer region is correspondingly reduced. With regard to that feature, reference is made to, for example, U.S. Pat. No. 5,649,992, the entire disclosure of which is hereby incorporated herein by reference.

CIG apparatuses may be provided in various forms, but each such CIG typically includes the following: (1) a passage is provided utilizing gravity to guide a melt; (2) at least a region of the wall of passage is cooled so as to allow formation of a skull of the melt on the wall; and (3) electrically conductive coils are associated with at least a portion of the passage, allowing inductive heating of molten material passing through the passage. Persons having ordinary skill in the art may readily provide an appropriately designed CIG having any one or all of the forgoing three features for use in an apparatus constructed according to the present invention without finer discussion herein.

The CIG is in direct or indirect fluid communication with the nucleated casting apparatus and transfers the refined molten material from the ESR apparatus to the casting apparatus. Nucleated casting is known in the art and is described in, for example, U.S. Pat. No. 5,381,847 and in D. E. Tyler and W. C. Watson, *Proceedings of the Second International Spray Forming Conference* (Olin Metals Research Labs., September 1996), each of which is hereby incorporated herein by reference. In nucleated casting, a liquid stream of metallic material is disrupted or broken into a cone of sprayed droplets by an impinging gas flow. The resultant cone of droplets is directed into a casting mold having bottom and side walls, where the droplets accumulate to provide a preform having a shape that conforms to the mold. The gas flow rate used to generate the droplets in the nucleated casting process is adjusted to provide a relatively low fraction of solid (relative to the spray forming process) within the individual droplets. This produces a low viscosity material that is deposited in the mold. The low viscosity semi-solid material fills and may conform to the contour of the mold. The impinging gas and impacting droplets create turbulence at the semi-solid surface of the casting as it is deposited, enhancing the uniform deposition of the casting within the mold. By depositing a semi-solid material into the mold with a gas flowing over the surface of the material as it is deposited, the solidification rate of the material is enhanced and a fine grain structure results.

As incorporated in the present invention in conjunction with the melting/refining apparatus and the transfer apparatus, the nucleated casting apparatus may be used to form relatively large cast preforms, preforms of 16 inches or more in diameter. Consumable feed electrodes cast through the apparatus of the invention may be of a size adequate to provide a continuous stream of molten material exiting from the outlet of the transfer apparatus over a prolonged period to deliver a large volume of molten material to the nucleated casting apparatus. Preforms that may be successfully cast by the nucleated casting process include alloys that otherwise are prone to segregation such as, for example, complex nickel-based superalloys, including alloy 706, alloy 718, alloy 720, Rene '88, titanium alloys (including, for example Ti(6-4) an Ti(17)), certain steels, and certain cobalt-base alloys. Other metallic materials that are prone to segregation upon casting will be readily apparent to those of ordinary skill. Preforms of such metallic materials may be formed to large diameters by nucleated casting without casting-related defects such as white spots, freckles, beta flecks, and center segregation. Of course, the apparatus of the invention also may be applied to cast preforms of metallic materials that are not prone to segregation.

As is the case with ESR and CIG, nucleated casting is well known in the art and one of ordinary skill may, without undue experimentation, after having considered the present description of the invention, construct a nucleated casting apparatus or adapt an existing apparatus to receive a melt from a transfer apparatus as in the present invention. Although nucleated casting and spray forming both use a gas to atomize a molten stream to form a plurality of molten alloy droplets, the two processes differ in fundamental respects. For example, the gas-to-metal mass ratios (which may be measured as kilograms of gas/kilograms of metal) used in each process differ. In the nucleated casting process incorporated in the present invention, the gas-to-metal mass ratio and the flight distance are selected so that before impacting the collection surface of the mold or the surface of the casting being formed up to about 30 volume percent of each of the droplets is solidified. In contrast, the droplets impacting the collection surface in a typical spray forming process, such as that described in, for example, U.S. Pat. No. 5,310,165 and European application no, 0 225 732, include about 40 to 70 volume percent of solid. To ensure that 40 to 70 percent of the spray droplets are solid, the gas-to-metal mass ratio used to create the droplet spray in spray forming typically is one or greater. The lower solids fractions used in nucleated casting are selected to ensure that the deposited droplets will conform to the casting mold and voids will not be retained within the casting. The 40-70 volume percent solids fraction used in the spray forming process is selected to form a free-standing preform and would not be suitable for the nucleated casting process.

An additional distinction of spray forming is that although both spray forming and nucleated casting collect the atomized droplets into a solid preform, in spray forming the preform is deposited on a rotating collector that lacks side walls to which the deposited material conforms. Significant disadvantages associated with that manner of collection include porosity in the preform resulting from gas entrapment and significant yield losses resulting from overspray. Although porosity may be reduced in spray formed ingots during hot working, the porosity may reappear during subsequent high temperature heat treatment. One example of that phenomenon is porosity resulting from argon entrapment in superalloys, which can appear during thermally induced porosity (TIP) testing and may act as nucleating sites for low cycle fatigue fractures.

Spray forming also has limited utility when forming large diameter preforms. In such cases a semi-liquid layer must be maintained on the sprayed surface at all times to obtain a satisfactory casting. This requires that any given segment of a surface being spray formed must not solidify between the time that it exits the spray cone, rotates with the collector about the rotational axis of the collector, and reenters the spray cone. That restriction (in combination with the limitation on rotational speed imposed by the centrifugal forces) has limited the diameter of preforms that may be spray formed. For example, spray forming devices with a single spray nozzle may only form preforms having a diameter no larger than about 12 inches. In the present invention, the inventors have found that the use of nucleated casting greatly increases the size of castings that may be formed from molten metallic materials prepared by the melting and refining apparatus/transfer apparatus combination. Because, relative to spray forming, the nucleated casting process may be configured to evenly distribute the droplets supplied to the mold and solidification may ensue rapidly thereafter, any residual oxides and carbonitrides in the preform will be small and finely dispersed in the preform microstructure. An even distribution of droplets may be achieved in the nucleated casting process by, for example, rastering the one or more droplet spray nozzles and/or translating and/or rotating the mold relative to the droplet spray in an appropriate pattern.

Figure 2:
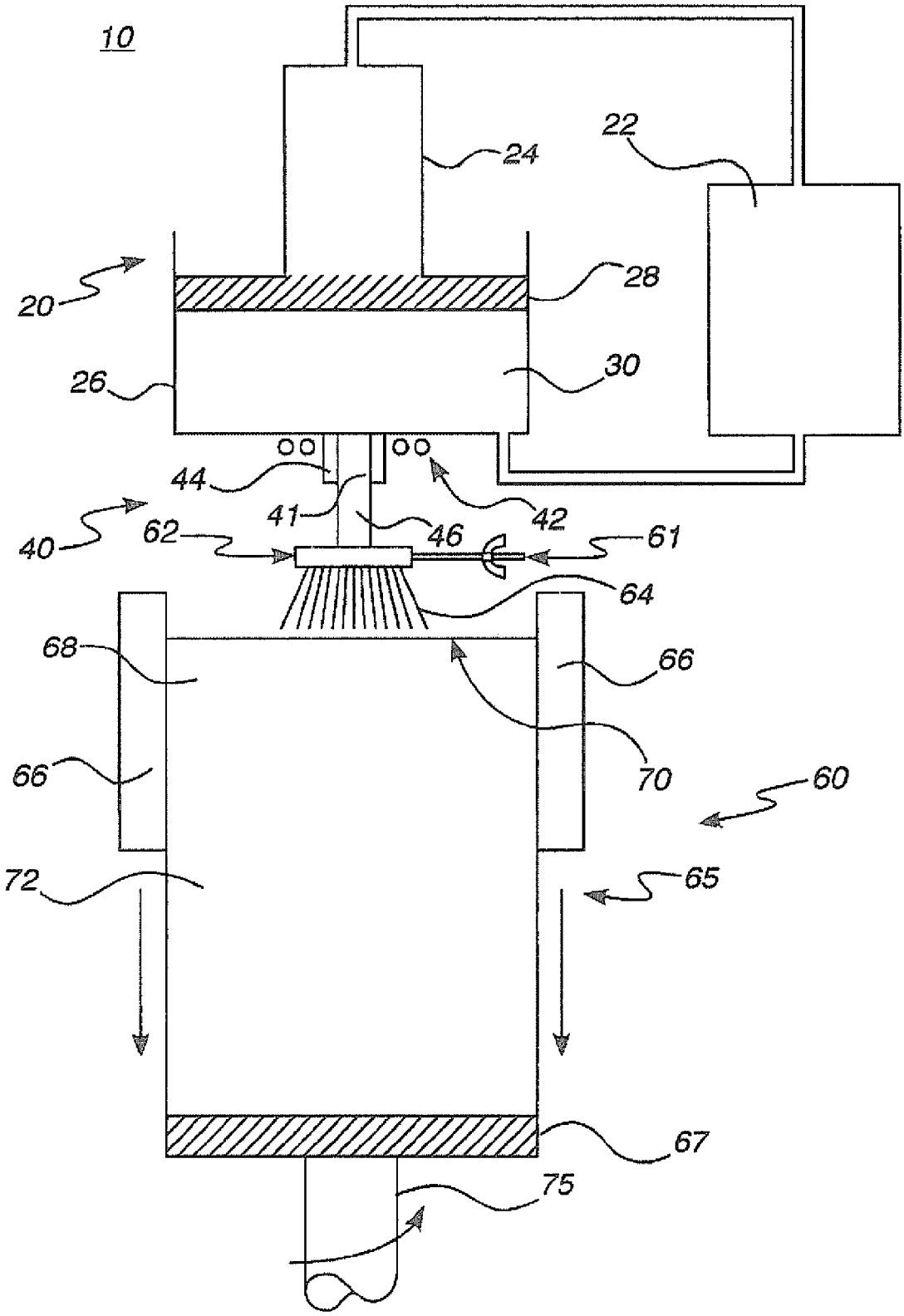
FIG. 2 is a schematic representation of an embodiment of a refining and casting apparatus constructed according to the present invention.

A schematic representation of a refining and casting apparatus 10 constructed according to the present invention is shown in FIG. 2. The apparatus 10 includes a melting and refining apparatus in the form of an ESR apparatus 20, a transfer apparatus in the form of CIG 40, and a nucleated casting apparatus 60. The ESR apparatus 20 includes an electric power supply 22 which is in electrical contact with a consumable electrode 24 of the metallic material to be cast. The electrode 24 is in contact with a slag 28 disposed in an open bottom, water-cooled vessel 26 that may be constructed of, for example, copper or another suitable material. The electric power supply 22 provides a high amperage, low voltage current to a circuit that includes the electrode 24, the slag 28, and the vessel 26. The power supply 22 may be an alternating or direct current power supply. As current passes through the circuit, electrical resistance heating of the slag 28 increases its temperature to a level sufficient to melt the end of the electrode 24 in contact with the slag 28. As the electrode 24 begins to melt, droplets of molten material form, and an electrode feed mechanism (not shown) is used to advance the electrode 24 into the slag 28 as the electrode melts. The molten material droplets pass through the heated slag 28, and the slag 28 removes oxide inclusions and other impurities from the material. After passing through the slag 28, the refined molten material 30 pools in the lower end of the vessel 26. The pool of refined molten material 30 then passes to a passage 41 within the CIG 40 by force of gravity.

The CIG 40 is closely associated with the ESR apparatus 20 and, for example, an upper end of the CIG 40 may be directly connected to the lower end of the ESR apparatus 20. In the apparatus 10, the vessel 26 forms both a lower end of the ESR apparatus 20 and an upper end of the CIG 40. Thus, it is contemplated that the melting and refining apparatus, transfer apparatus, and nucleated casting apparatus of the refining and casting apparatus of the invention may share one or more elements in common. The CIG 40 includes a funnel-shaped transfer portion 44 surrounded by current carrying coils 42. Electrical current is provided to the coils 42 by an alternating current source (not shown). The coils 42 serve as induction heating coils and are used to selectively heat the refined molten material 30 passing through the transfer portion 44. The coils 42 are cooled by circulating a suitable coolant such as water through conduits associated with the transfer portion 44. The cooling effect of the coolant also causes a skull (not shown) of solidified material to form on the inner wall of the transfer portion 44. Control of the heating and/or cooling of the transfer portion 44 may be used to control the rate of, or to interrupt entirely, the flow of molten material 30 through the CIG 40. Preferably, the CIG 40 is closely associated with the ESR apparatus 20 so that the molten refined material exiting the ESR apparatus 20 is protected from the atmosphere and does not, for example, undergo oxidation.

Molten material exits a bottom orifice 46 of the CIG 40 and enters the nucleated casting apparatus 60. In the nucleated casting apparatus 60, a supply of suitably inert atomizing gas 61 is delivered to an atomizing nozzle 62. The flow of gas 61 exiting the atomizing nozzle 62 impinges the stream of molten material 30 and breaks the stream into droplets 64. The resulting cone of droplets 64 is directed into a casting mold 65 including a side wall 66 and a base 67. As the material is deposited into the mold 65, the base 67 may rotate to better ensure uniform deposition of the droplets. The droplets 64 produced by the apparatus 10 are larger than those of conventional spray casting. The larger droplets 64 are an advantage over conventional spray casting in that they exhibit reduced oxygen content and require less gas consumption for atomization. Also, the gas-to-metal ratio of the droplets produced by the nucleated casting apparatus 60 may be less than one-half that conventionally used in spray forming. The flow rate of gas 61 and the flight distance of the droplets 64 are adjusted to provide a semi-solid material of a desired solid to liquid ratio in the casting mold 65. The desired solid to liquid ratio is in the 5%-40% range, volume per volume. The relatively low solids fraction of the droplets directed into the casting mold 65 results in the deposit of a low viscosity semi-solid material 68 that conforms to the shape of the casting mold 65 as it is filled.

The impact of the spray of droplets 64 creates a turbulent zone at the uppermost surface 70 of the preform 72. The depth of the turbulent zone is dependent upon the velocity of the atomization gas 61 and the size and velocity of the droplets 64. As the droplets 64 begin to solidify, small particles of solid form in the liquid having the lattice structure characteristic of the given material. The small particle of solid which begins to form in each of the droplets then acts as a nucleus onto which other atoms in the vicinity tend to attach themselves. During solidification of the droplets 64, many nuclei form independently at various locations and have random orientation. The repetitive attachment of succeeding atoms results in the growth of crystals composed of the same basic patterns that extend outward from the respective nuclei until the crystals begin to intersect with one another. In the present invention, sufficient nuclei are present as fine dendritic structures within each of the droplets 64 so that the resulting preform 72 formed will consists of a uniform equiaxed grain structure.

To maintain the desired solids fraction in the material deposited in the casting mold 65, the distance between the point of atomization and the upper surface 70 of the preform 72 is controlled. Thus, the apparatus 10 of the present invention may also include a means for adjusting this distance comprising a retractable stalk 75 attached to the base 67 of the mold 65. As the material is deposited and conforms to the side wall 66, the base 67 is continuously retracted downward so that the distance between the atomizing nozzle 62 and the surface 70 of the preform 72 is maintained. Retraction of the base 67 downward exposes a portion of the walls of the solidified preform below the wall 66 of the mold 65.

Although only a single combination of a CIG and nucleated casting apparatus is included in the apparatus 10, it is contemplated that multiple atomizing spray apparatuses or multiple combinations of a melting and refining apparatus (such as an ESR apparatus) with an atomizing spray apparatus feeding a single casting mold may be advantageous. For example, a system employing multiple transfer apparatus/atomizing nozzle combinations downstream of a single ESR apparatus would permit ingots of greater diameters to be manufactured because the multiple atomized sprays may cover a greater area in the mold. In addition, process rates would increase and costs would be reduced. Alternatively, a single or multiple ESR or other melting and refining apparatuses may feed multiple atomizing nozzles directed at several molds so as to create multiple preforms from a single feed electrode supplied to the melting and refining apparatus.

Other possible modifications to the above-described apparatus 10 of the invention include: adapting the nucleated casting apparatus 60 so as to rotate the nucleated casting cast preform 72 during processing to give a more even distribution of the droplet spray over a large surface; the use of multiple atomizing nozzles to feed a single mold; and equipping the apparatus 10 so that the one or more atomizing nozzles can oscillate. As noted above, a VAR apparatus is one melting and refining apparatus that may be used in place of the ESR apparatus 20 to melt the consumable electrode 24. In VAR, the consumable electrode is melted by application of DC current and does not pass through a conductive slag.

Another possible modification to the apparatus 10 is to incorporate a member having a passage therethrough and constructed with walls of ceramic or other suitable refractory material as the transfer apparatus in place of the CIG 40 to transfer the material melted in the ESR apparatus 20 (or other melting and refining apparatus) to the nucleated casting apparatus 60. In such case, the passage within the transfer apparatus would not be associated with means to heat the material passing therethrough and, accordingly, there would be less flexibility in regulating the flow of the molten material to the nucleated casting apparatus 60.

The apparatus 10 also may be adapted to modify the manner of withdrawal of the preform 72 and to maintain acceptable surface finish on the preform 72. For example, the apparatus 10 may be constructed so that the casting mold 65 reciprocates (i.e., the mold moves up and down), the casting mold 65 oscillates, and/or the preform 72 reciprocates in a manner solar to that used in conventional continuous casting technology. Another possible modification is to adapt the apparatus such that the one or more atomizing nozzles move to raster the spray and increase coverage on the surface of the preform. The apparatus may be programmed to move the one or more nozzles in any suitable pattern.

Also, to better ensure minimizing porosity in the preform, the chamber in which the nucleated casting occurs may be maintained at partial vacuum such as, for example, ⅓ to ⅔ atmosphere. Maintaining the chamber under partial vacuum also has the advantage of better maintaining the purity of the material being cast. The purity of the material also may be maintained by conducting the casting in a protective gas atmosphere. Suitably protective gases include, for example, argon, helium, hydrogen, and nitrogen.

Although the foregoing description of the casting apparatus 10 refers to the ESR apparatus 20), transfer apparatus (CIG 40), and nucleated casting apparatus 60 as relatively discrete apparatuses associated in series, it will be understood that the apparatus 10 need not be constructed in that way. Rather than being constructed of discrete, disconnectable melting/refining, transfer, and casting apparatuses, the apparatus 10 may incorporate the essential features of each of those apparatuses without being capable of deconstruction into those discrete and individually operable apparatuses. Thus, reference in the appended claims to a melting and refining apparatus, a transfer apparatus, and a nucleated casting apparatus should not be construed to mean that such distinct apparatuses may be disassociated from the claimed apparatus without loss of operability.

The following computer simulations and actual examples confirm advantages provided by the apparatus and method of the present invention.

Example 1

Computer Simulation

Figure 3:
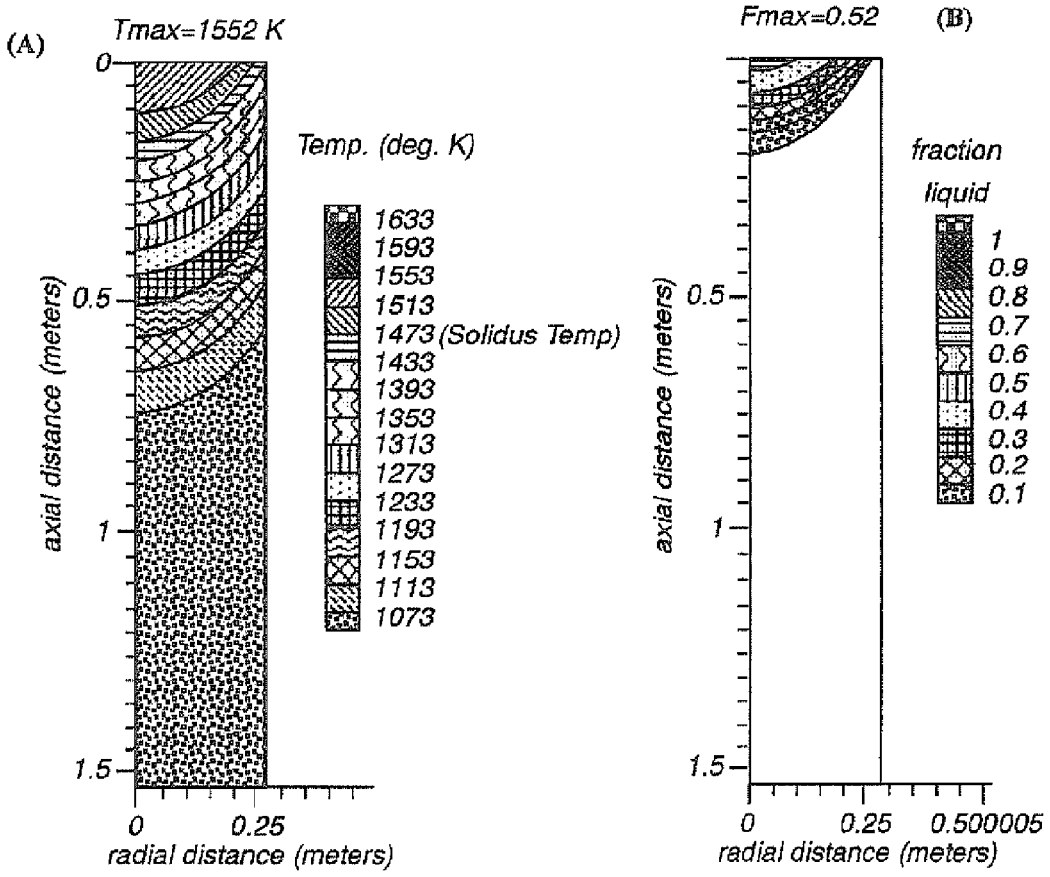
FIGS. 3(*a*) and (*b*) are graphs illustrating parameters calculated for a simulated casting of a melt of alloy 718 using a refining and casting apparatus constructed as shown schematically in FIG. 2, and operated with a mass flow rate of 8.5 lbs./minute.

Computer simulations show that preforms prepared by the apparatus 10 of the invention will cool significantly faster than ingots produced by conventional processing. FIG. 3 (mass flow rate to caster of 0.065 kg/sec. or about 8.5 lb/min.) and FIG. 4 (mass flow rate to caster of 0.195 kg/sec.) illustrate the calculated effects on the temperature and liquid volume fraction of a preform cast by the apparatus 10 of the present invention sing the parameters shown in Table 1 below.

TABLE 1

| Parameters of Simulated Castings |
|---|
| Preform Geometry |
| Cylindrical 20 inch (508 mm) preform diameter<br>Inflow region constitutes entire top surface of preform |
| Nucleated Casting Apparatus Operating Conditions |
| Mass flow rates of 0.065 kg/sec. (as reported in the reference of footnote 1 below for a comparable VAR process) (FIG. 3) and 0.195 kg/sec. (FIG. 4) 324° K (51° C.) average temperature of the cooling water in the mold. 324° K (51° C.) effective sink temperature for radiation heat loss from the ingot top surface.<br>Alloy flowing into the mold is at the liquidus temperature of the alloy.<br>Heat loss coefficients due to convection from the top surface of preform as per E. J. Lavernia and Y. Wu., "Spray Atomization and Deposition" (John Wiley & Sons., 1996), pp. 311–314, with gas-to-metal ratio of 0.2, and side surface 0 $W/m^2K$. The disclosure of the Lavernia and Wu reference is hereby incorporated herein by reference. |
| Preform Material and Thermophysical Properties |
| Alloy 718.<br>Liquidus and solidus temperatures of 1623° K and 1473° K, respectively (as reported in the reference of footnote 1 below).<br>Emmissivities of 005 (top surface) and 0.2 (side surface).<br>Model for Heat Transfer to Mold<br>The model for heat transfer to the mold is that described in the reference of n. 1, wherein the heat transfer boundary condition transitions linearly from a fall contact condition for surface preform temperatures greater than the liquidus temperature to a gap heat transfer condition for surface temperatures less than the solidus temperature.<br>20 inc (508 mm) diameter mold. |

[1]L. A. Bertram et al., "Quantitative Simulations of a Superalloy VAR Ingot at the Macroscale", Proceedings of the 1997 International Symposium on Liquid Metal processing and Casting, A. Mitchell and P. Auburtin, eds. (Am. Vac. Soc., 1997). The reference is hereby incorporated herein by reference.

Figure 4:
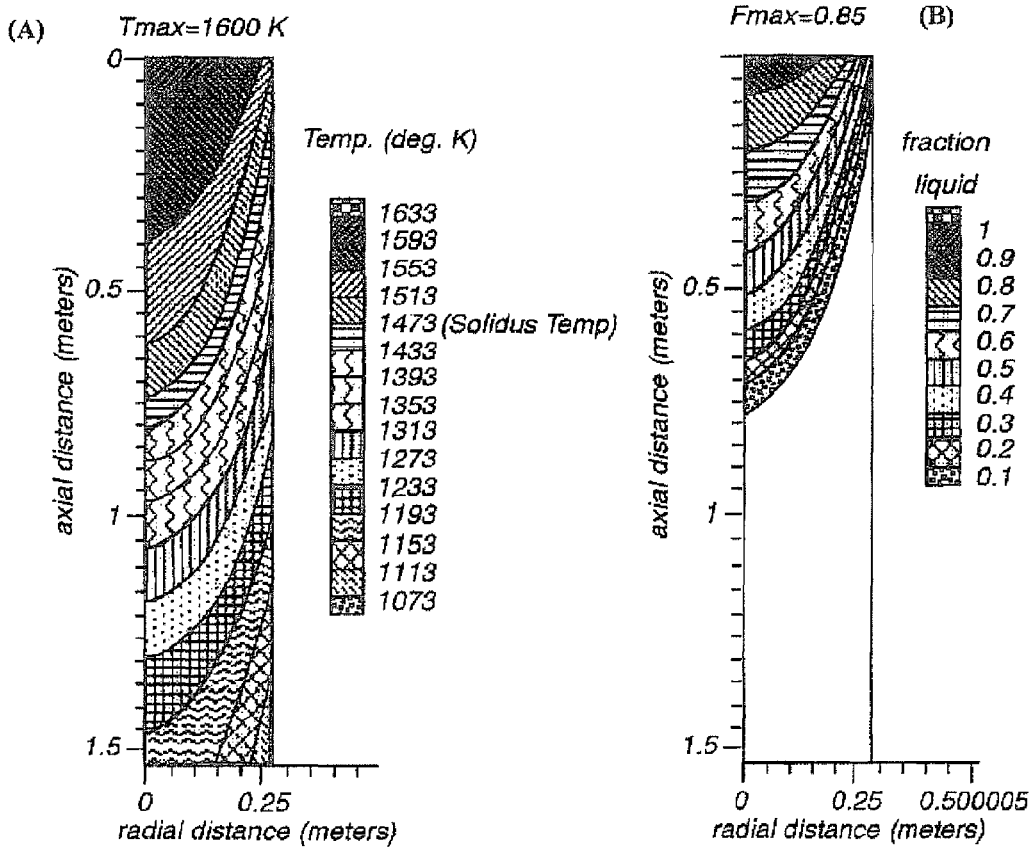
FIGS. 4(*a*) and (*b*) are graphs illustrating parameters calculated for a simulated casting of a melt of alloy 718 using a refining and casting apparatus constructed as shown schematically in FIG. 2, and operated with a mass flow rate of 25.5 lbs./minute.

The isotherm data provided graphically in FIGS. 3 and 4 demonstrates that the surface temperature of the preform produced in the simulations is below the liquidus temperature of the alloy. The maximum preform temperatures calculated for FIGS. 3 and 4 are 1552° K and 1600° K, respectively. Therefore, the pool under the spray will be semi-solid, and the semi-solid nature of the pool is shown by the liquid fraction data that is graphically shown in FIGS. 3 and 4.

Table 2 below compares certain results of the computer simulations with typical results of a VAR casting of a perform of similar size reported in the reference of n. 1. Table 2 shows that the pool of material on the surface of a preform prepared by the apparatus 10 of the present invention may be semi-solid, while that produced by conventional VAR processing is fully liquid up to 6 inches below the surface. Thus, for a given preform size, there is substantially less latent heat to be removed from the region of solidification of a preform cast by an apparatus constructed according to the present invention. That, combined with the semi-solid nature of the pool, will minimize microsegregation and the possibility of freckle formation, center segregation, and other forms of detrimental macrosegregation. In addition, the present invention also completely eliminates the possibility of white spot defect formation, a defect inherent in the VAR process.

TABLE 2

Comparison Of Invention With VAR Cast Ingot

| Process | Maximum Surface Temp. ° K (° F.) | Pool Depth (depth of liquidus at axis) | Maximum Liquid Volume Fraction on Surface |
|---|---|---|---|
| Simulation @ 8.5 lbs./minute mass flow rate (20" diameter preform formed by nucleated casting) | 1552° K (2334° F.) | 0 inches | 0.52 |
| Simulation @ 25.5 lbs./minute mass flow rate (20" diameter preform formed by nucleated casting) | 1600° K (2421° F.) | 0 inches | 0.85 |
| Standard VAR @ 8.5 lbs./minute mass flow rate (20" diameter ingot formed) | 1640° K (2493° F.) | 6 inches | 1 |

Example 2

Trial Casting

Figure 5:
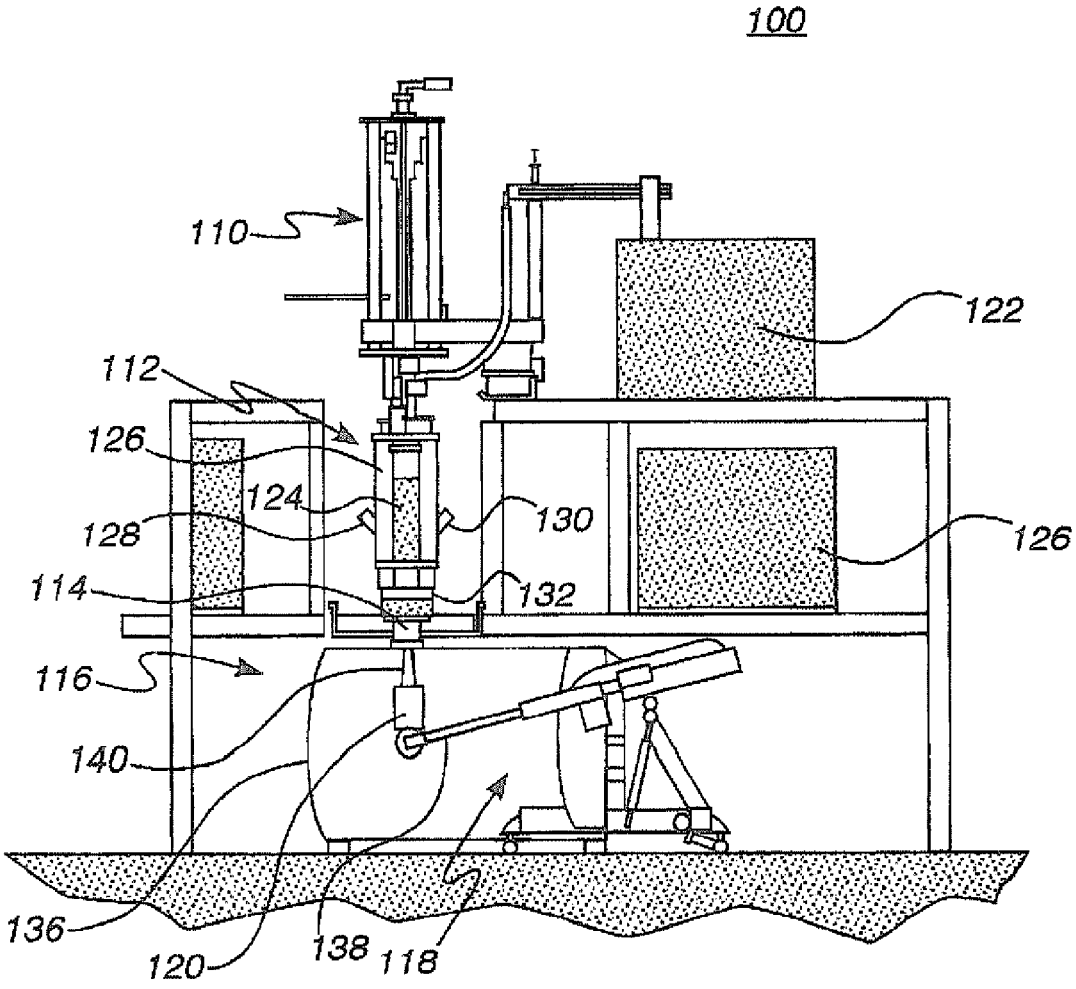
FIG. 5 depicts the embodiment of the apparatus of the invention used in the trial castings of Example 2.

A trial casting using an apparatus constructed according to the invention was performed. The apparatus 100 is shown schematically in FIG. 5 and, for purposes of understanding its scale, was approximately thirty feet in overall height. The apparatus 100 generally included ESR head 110, ESR furnace 112, CIG 114, nucleated casting apparatus 116, and material handling device 118 for holding and manipulating the mold 120 in which the casting was made. The apparatus 100 also included ESR power supply 122 supplying power to melt the electrode, shown as 124, and CIG power supply 126 for powering the induction heating coils of CIG 114.

ESR head 110 controlled the movement of the electrode 124 within ESR furnace 112. ESR furnace 112 was of a typical design and was constructed to hold an electrode of approximately 4 feet in length by 14 inches in diameter. In the case of the alloy used in the trial casting, such an electrode weighed approximately 2500 pounds. ESR furnace 112 included hollow cylindrical copper vessel 126 having view ports 128 and 130. View ports 128 and 130 were used to add slag (generally shown as 132) to, and to assess the temperature within, ESR furnace 112. CIG 114 was about 10" in vertical length and was of a standard design including a central bore for passage of molten material surrounded by copper walls including coolant circulation passages. The copper walls were, in turn, surrounded by induction heating coils for regulating the temperature of the material passing through CIG 114.

Nucleated casting apparatus 116 included chamber 136 surrounding mold 120. Chamber 136 enclosed mold 120 in a protective nitrogen atmosphere in which the casting was carried out. The walls of chamber 136 are shown transparent in FIG. 5 for purposes of viewing mold 120 and its associated equipment within chamber 136. Mold 120 was held at the end of robot arm 138 of material handling device 118. Robot arm 138 was designed to support and translate mold 120 relative to the spray of molten material, shown generally as 140, emanating from the nozzle of nucleated casting apparatus 116. In the trial casting, however, robot arm 138 did not translate the mold 120 during casting. An additional advantage of chamber 136 is to collect any overspray generated during casting.

The supplied melt stock was a cast and surface ground 14 inch diameter VIM electrode having a ladle chemistry shown in Table 3. The electrode was electroslag remelted at a feed rate of 33 lbs./minute using apparatus 100 of FIG. 5. The slag used in the ESR furnace 112 had the following composition, all components shown in weight percentages: 50% $CaF_2$, 24% CaO, 24% $Al_2O_3$, 2% MgO. The melt refined by the ESR treatment was passed through CIG 114 to nucleated casting apparatus 116. CIG 114 was operated using gas and water recirculation to regulate temperature of the molten material within the CIG 114. Argon gas atomization was used to produce the droplet spray within nucleated casting apparatus 116. The minimum 0.3 gas-to-metal ratio that could be used with the atomizing nozzle incorporated into the nucleated casting apparatus 116 was employed. The atomized droplets were deposited in the center of mold 120, which was a 16 inch diameter, 9 inch depth (interior dimensions) uncooled 1 inch thick steel mold with Kawool insulation covering the mold baseplate. As noted above, mold 120 was not rastered, nor was the spray cone rastered as the preform was cast.

Centerline plates were cut from the cast preform and analyzed. In addition a 2.5×2.5×5 inch section from the mid-radius position was upset forged from 5 inches to 1.7 inches height at 1950° F. to enhance etch inspectability for macro-segregation. The chemistry of the cast preform at two positions is provided in Table 3.

TABLE 3

Ladle and Cast Preform Chemistry

| | Ladle Chemistry | Preform Chemistry (Center) | Preform Chemistry (Near Surface) |
|---|---|---|---|
| Ni | 53.66 | 53.85 | 53.65 |
| Fe | 17.95 | 18.44 | 18.41 |
| Cr | 17.95 | 18.15 | 18.17 |
| Nb | 5.44 | 5.10 | 5.16 |
| Mo | 2.86 | 2.78 | 2.79 |
| Ti | 0.98 | 0.86 | 0.87 |
| Al | 0.55 | 0.59 | 0.61 |
| V | 0.02 | 0.02 | 0.02 |
| Co | 0.02 | 0.05 | 0.05 |
| Cu | 0.01 | 0.05 | 0.05 |
| Mn | <0.01 | 0.03 | 0.03 |
| Si | <0.01 | 0.01 | 0.02 |
| W | <0.01 | <0.01 | <0.01 |
| Ta | <0.01 | <0.01 | <0.01 |
| Zr | <0.01 | <0.01 | <0.01 |
| P | <0.003 | 0.004 | 0.003 |
| S | 0.0008 | <0.0003 | <0.0003 |
| O | 0.0006 | 0.0008 | 0.0008 |
| N | 0.0018 | 0.0038 | 0.0042 |
| C | 0.024 | 0.023 | 0.022 |

A tin addition was made to the molten ESR pool at the fourteenth minute of the fifteen-minute spraying ran to mark the liquidus pool depth. The tin content was measured every 0.25 inch after deposition. The measured distance between the liquidus and solidus boundaries was estimated to be 4-5 inches. This confirmed the shallow melt pool predicted by the model described in Example 1. Visual inspection of the preform revealed certain defects indicating that the deposited material required additional fluidity to fill the entire mold. No attempt was made to "hot top" the preform by reducing the gas-to-metal ratio or pouring the stream of metallic material without atomization. Suitable adjustment to the deposition process may be made in order to inhibit formation of defects within the preform.

Figure 6:
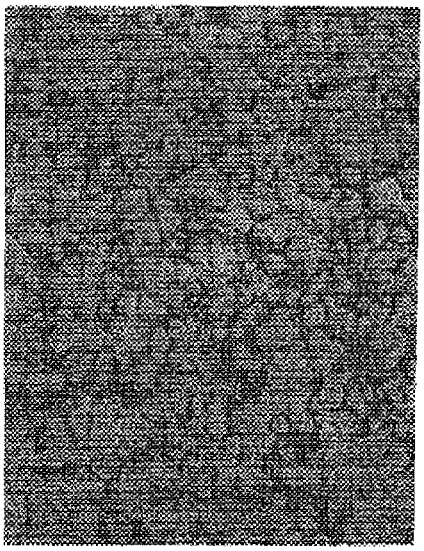
FIG. 6 is an as-sprayed center longitudinal micrograph (approximately 50× magnification) of an ingot cast using an apparatus constructed according to the present invention, and demonstrating an equiaxed ASTM 4.5 grain structure.
Figure 7:
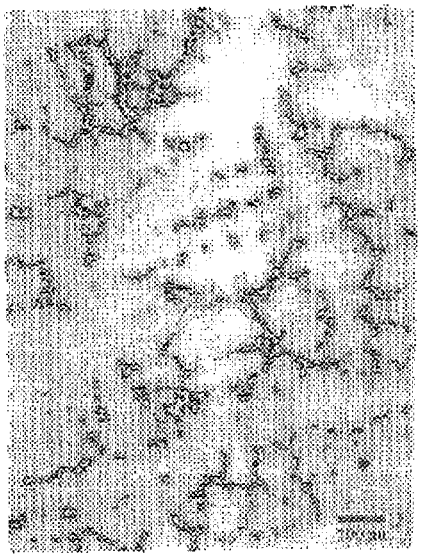
FIG. 7 is an as-cast micrograph taken from a 20-inch diameter VAR ingot (approximately 50× magnification).

The as-sprayed structure of the preform produced by the above nucleated casting process and an as-cast micrograph from a 20 inch diameter VAR ingot of the same material are shown in FIGS. 6 and 7, respectively. The nucleation cast (NC) preform (FIG. 6) possesses a uniform, equiaxed ASTM 4.5 grain structure with Laves phase present on the grain boundaries. δ phase also appears at some grain boundaries, but probably precipitated during a machining anneal conducted on the cast preform material. The VAR ingot includes a large grain size, greater Laves phase volume, and larger Laves particles than the spray cast material (>40 μm for VAR vs. <20 μm for spray cast).

Macrosegregation-related defects such as white spots and freckles were not observed in the preform. A malt was upset forged to refine grain structure and aid in detection of defects. A macro plate from the forging did not reveal any macrosegregation defects. The oxide and carbide dispersions of the preform material were refined relative to VAR ingot material and were similar to that found in spray formed material. Carbides were less than 2 micrometers and oxides were less 10 micrometers in size in the preform. Typically, 20 inch diameter preforms of alloy 718 cast by conventional VAR have carbides of 6-30 microns and oxides of 1-3 microns up to 300 microns in the microstructure. The carbides and oxides seen in material cast by the present invention are typical of those seen in spray forming, but are finer (smaller) than those seen in other melt processes such as VAR. These observations confirm that more rapid solidification occurs in the method of the invention than in conventional VAR ingot melting of comparably sized ingots, even though the method of the invention typically uses a much higher casting rate than VAR.

The chemistry analyses shown in Table 3 do not reveal any elemental gradients. In particular, no niobium gradient was detected in the preform. Niobium is of particular interest because migration of that element from the preform surface to the center has been detected in spray formed ingots. Table 3 does demonstrate differences between the ladle chemistry and ingot chemistry for the preform. Those differences are attributed to porosity in the preform samples used in the XRF procedure rather than actual difference in chemistry.

Based on the results of the experimental casting, a lower gas-to-metal ratio is desirable to enhance mold fill and inhibit porosity problems. Use of a more fluid spray may increase microsegregation to some extent, but the wide beneficial margin exhibited in the trial over VAR should accommodate any increase. Grain size also may increase with increasing fluidity, but the constant impingement of new droplets provides a high density of grain nucleation sites to inhibit formation of large or columnar grains within the preform. Greater spray fluidity would significantly enhance the ability of the droplets to fill the mold, and a more fluid impingement zone would reduce sidewall rebound deposition. An additional advantage of a more fluid impingement zone is that the atomizing gas will more readily escape the material and a reduction in porosity will result. To enhance outgassing of the atomizing gas from the preform surface, the casting may be performed in a partial vacuum such as, for example ½ atmosphere. Any increase in size of carbides and oxides resulting from reducing the gas-to-metal ratio is expected to be slight. Thus, an advantageous increase in fluidity of the droplet spray is expected to have only minor effects on grain structure and second phase dispersion.

Accordingly, the apparatus and method of the present invention address significant deficiencies of current methods of casting large diameter preforms from alloys prone to segregation. The melting and refining apparatus provides a source of refined molten alloy that is essentially free from deleterious oxides. The transfer apparatus provides a method of transferring the refined molten alloy to the nucleated casting apparatus with a reduced possibility of oxide recontamination. The nucleated casting apparatus may be used to advantageously form small grained, large diameter ingots from segregation prone alloys without the casting-related defects associated with VAR and/or spray casting.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

We claim:

1. An apparatus for producing a preform of a metallic material by nucleated casting, the apparatus comprising:

a melting and refining apparatus;

a transfer apparatus in fluid communication with said melting and refining apparatus; and a nucleated casting apparatus configured to spray droplets of the metallic material having a 5%-40% v/v solid to liquid ratio, wherein said nucleated casting apparatus comprises:

a single atomizing nozzle, wherein said atomizing nozzle is in fluid communication with said transfer apparatus, wherein said transfer apparatus comprises a sealed conduit between said melting and refining apparatus and said atomizing nozzle;

a mold in which the preform is formed, wherein said mold comprises an inner diameter of at least 12 inches, a base, a sidewall, and an axis of rotation, wherein said base rotates about said axis of rotation, and wherein said base is movable relative to said sidewall along said axis of rotation to control a distance between said atomizing nozzle and said base; and a stalk connected to said base, wherein said stalk is configured to move said base with respect to said sidewall along said axis of rotation;

wherein said mold is positioned with a chamber configured to maintain at least one of a partial vacuum and a protective gas atmosphere within said chamber; and wherein said atomizing nozzle is configured to at least one of selectively oscillate with respect to said mold and selectively spray the metallic material into said mold along an axis collinear with said axis of rotation.

2. The apparatus of claim 1, wherein said nucleated casting apparatus further comprises an atomizing gas supply in communication with said nozzle.

3. The apparatus of claim 1, wherein said atomizing nozzle selectively rasters with respect to said mold.

4. The apparatus of claim 1, wherein said melting and refining apparatus is selected from an electroslag remelting apparatus and a vacuum arc remelting apparatus.

5. The apparatus of claim 1, wherein said melting and refining apparatus is a vacuum arc remelting apparatus.

6. The apparatus of claim 1, wherein said nucleated casting apparatus is configured to spray a droplet of the metallic material having up to about 30 volume percent solidified.

7. The apparatus of claim 1, wherein said inner diameter is at least 14 inches.

8. A nucleated casting apparatus for producing a preform of a metallic material, comprising:

a single atomizing nozzle, wherein said atomizing nozzle is in sealed fluid communication with a source of refined molten material by way of an intermediate transfer apparatus;

a mold in which the preform is formed, wherein said mold comprises:

an interior diameter of at least 12 inches;

a base;

a sidewall including a top surface and a bottom surface; and an axis of rotation, wherein said base rotates about said axis of rotation and is retractable relative to said top surface along said axis of rotation to a position below said bottom surface to expose a portion of said preform below said sidewall to control a distance between said top surface and said base; and a stalk connected to said base, wherein said stalk is configured to retract said base with respect to said sidewall along said axis of rotation;

wherein said mold is positioned within a chamber configures to maintain at least one of a partial vacuum and a protective gas atmosphere within said chamber;

wherein said atomizing nozzle is configured to at least one of selectively oscillate with respect to said mold and selectively spray the refined molten material into said mold along an axis collinear with said axis of rotation; and wherein the nucleated casting apparatus is configured to spray droplets of the refined molten material having a 5%-40% v/v solid to liquid ratio.

9. The nucleated casting apparatus of claim 8, further comprising:

an atomizing gas supply in communication with said nozzle.

10. The nucleated casting apparatus of claim 9, wherein said atomizing nozzle selectively rasters with respect to said mold.

11. An article produced by a method comprising the steps of:

melting a metallic material to provide a molten material;

passing the molten material through a sealed transfer apparatus such that the molten material is protected from the atmosphere;

forming a droplet spray of the molten material comprising droplets having a 5%-40% v/v solid to liquid ratio by impinging a gas on a flow of the molten material from a single atomizing nozzle; and depositing the droplet spray of the molten material within a mold comprising:

an inner diameter of at least 12 inches;

a base;

a sidewall including a top surface; and an axis of rotation, wherein the base rotates about the axis of rotation, and is retractable relative to the top surface along the axis of rotation to control a distance between the top surface and the base;

wherein a stalk is connected to the base and is configured to retract the base with respect to the sidewall along the axis of rotation; and wherein the mold is positioned within a chamber configured to maintain at least one of a partial vacuum and a protective gas atmosphere within the chamber;

wherein the atomizing nozzle is configured to at least one of selectively oscillate with respect to the mold and selectively spray the molten material into the mold along an axis collinear with the axis of rotation.

12. The article of claim 11, wherein depositing the droplet spray comprises generating a turbulent zone on a surface of the article by impact of the droplets of the molten material and the impinging gas.

13. An apparatus for producing a preform of a metallic material by nucleated casting, the apparatus comprising:

a melting and refining apparatus;

a transfer apparatus in fluid communication with said melting and refining apparatus;

a nucleated casting apparatus configured to spray droplets of the metallic material having a 5%-40% v/v solid to liquid ratio, wherein said nucleated casting apparatus comprises:

a single atomizing nozzle, wherein said atomizing nozzle is in fluid communication with said transfer apparatus, wherein said transfer apparatus comprises a sealed conduit between said melting and refining apparatus and said atomizing nozzle;

a mold comprising a base on which the preform is formed, wherein said mold further comprises a sidewall, an interior width of at least 12 inches, and an axis of rotation, and wherein said base is rotatable and withdrawable relative to said sidewall along said axis of rotation; and a stalk connected to said base, wherein said stalk is configured to move said base with respect to said sidewall along said axis of rotation;

wherein said mold is positioned within a chamber configured to maintain at least one of a partial vacuum and a protective gas atmosphere within the chamber; and wherein said atomizing nozzle is configured to at least one of selectively oscillate with respect to said mold and selectively spray the metallic material into said mold along an axis collinear with said axis of rotation.

* * * * *